US010775717B2

(12) United States Patent
Kouzu

(10) Patent No.: US 10,775,717 B2
(45) Date of Patent: Sep. 15, 2020

(54) IMAGE FORMING APPARATUS HAVING A SUPPORT BELOW A TRANSFER BELT AND A LEVER FOR RAISING THE SUPPORT, AND METHOD

(71) Applicant: Toshiba Tec Kabushiki Kaisha, Tokyo (JP)

(72) Inventor: Norio Kouzu, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/536,114

(22) Filed: Aug. 8, 2019

(65) Prior Publication Data

US 2020/0201208 A1 Jun. 25, 2020

(30) Foreign Application Priority Data

Dec. 19, 2018 (JP) ..... 2018-237768

(51) Int. Cl.
*G03G 15/16* (2006.01)
*G03G 21/12* (2006.01)
*G03G 21/16* (2006.01)

(52) U.S. Cl.
CPC ..... *G03G 15/161* (2013.01); *G03G 15/1615* (2013.01); *G03G 15/1685* (2013.01); *G03G 21/12* (2013.01); *G03G 21/1647* (2013.01)

(58) Field of Classification Search
USPC ..... 399/308
See application file for complete search history.

(56) References Cited

U.S. PATENT DOCUMENTS 7,400,852 B2 * 7/2008 Furukawa ..... G03G 21/168 399/299
8,417,164 B2 * 4/2013 Ichihashi ..... G03G 15/161 399/302

(Continued)

FOREIGN PATENT DOCUMENTS

JP 04149569 A * 5/1992
JP 2006-285296 A 10/2006

(Continued)

OTHER PUBLICATIONS

Extended European Search Report dated May 18, 2020 in corresponding European Patent Application No. 19201899.2, 9 pages.

*Primary Examiner* — Quana Grainger
(74) *Attorney, Agent, or Firm* — Kim & Stewart LLP

(57) ABSTRACT

An image forming apparatus includes photosensitive drums, a transfer belt having an outer surface facing the photosensitive drums, a tension roller in contact with an inner surface of the transfer belt, a cam in contact with the tension roller and movable to a first position to increase the tension to the transfer belt and a second position to decrease the tension to the transfer belt, a support having a supporting surface facing the outer surface of the transfer belt, and a lever mechanically linked to the cam and the support and rotatable from a third position at which the cam is in the first position to a fourth position at which the cam is in the second position. As the lever is moved from the third to the fourth position, the supporting surface is raised against the outer surface of the transfer belt.

20 Claims, 15 Drawing Sheets

(56) References Cited

U.S. PATENT DOCUMENTS

| | | | | |
|---|---|---|---|---|
| 8,811,867 | B2 * | 8/2014 | Ichihashi | G03G 15/161 399/302 |
| 10,175,615 | B1 | 1/2019 | Kouzu | |
| 2007/0071486 | A1 | 3/2007 | Chiba et al. | |
| 2007/0116496 | A1 * | 5/2007 | Morimoto | G03G 15/0131 399/299 |
| 2008/0095556 | A1 | 4/2008 | Mochizuki | |
| 2012/0003006 | A1 * | 1/2012 | Tachiki | G03G 15/161 399/121 |
| 2015/0277298 | A1 * | 10/2015 | Suzuki | G03G 15/168 399/101 |

FOREIGN PATENT DOCUMENTS

| | | | | |
|---|---|---|---|---|
| JP | 2008-268452 | A | | 11/2008 |
| JP | 2011033787 | A | * | 2/2011 |
| JP | 5382492 | B2 | | 1/2014 |
| JP | 5510186 | B2 | | 6/2014 |
| JP | 2018097211 | A | * | 6/2018 |

* cited by examiner

IMAGE FORMING APPARATUS HAVING A SUPPORT BELOW A TRANSFER BELT AND A LEVER FOR RAISING THE SUPPORT, AND METHOD

CROSS-REFERENCE TO RELATED APPLICATIONS

This application is based upon and claims the benefit of priority from Japanese Patent Application No. P2018-237768, filed on Dec. 19, 2018, the entire contents of which are incorporated herein by reference.

FIELD

Embodiments relate to an image forming apparatus and method of replacing image process units in an image forming apparatus.

BACKGROUND

Conventionally, an image forming apparatus (for example, a multifunction peripheral or MFP) includes a transfer belt and an image process unit including a photosensitive drum. The image process unit including the photosensitive drum is a consumable item, that the user replaces as needed. In order to prevent the transfer belt from being damaged at the time of replacing the image process unit, it is necessary to separate the transfer belt from the photosensitive drum. In order to bring the transfer belt into a non-contact state with respect to the photosensitive drum, the transfer belt is moved by a position switching roller arranged inside the transfer belt.

However, when the transfer belt is deteriorated and stretched by use over time, a sufficient tension cannot be applied to the transfer belt. Therefore, it becomes difficult to sufficiently separate the transfer belt from the photosensitive drum. As a result, a part of the image process unit is rubbed or hooked to the transfer belt to damage the transfer belt when the image process unit is replaced.

DETAILED DESCRIPTION

An image forming apparatus according to an embodiment includes a plurality of photosensitive drums, a transfer belt above the photosensitive drums and having an outer surface that faces the photosensitive drums, a tension roller in contact with an inner surface of the transfer belt, a cam that is in contact with the tension roller and is movable to a first position at which the cam applies a first tension to the transfer belt through the tension roller and a second position at which the cam applies a second tension less than the first tension to the transfer belt through the tension roller, a support below the transfer belt and having a supporting surface that faces the outer surface of the transfer belt, and a lever that is mechanically linked to the cam and the support and is rotatable from a third position at which the cam is in the first position to a fourth position at which the cam is in the second position. As the lever is moved from the third position to the fourth position, the supporting surface is raised against the outer surface of the transfer belt.

Hereinafter, an image forming apparatus according to an embodiment will be described with reference to the drawings.

Figure 1:
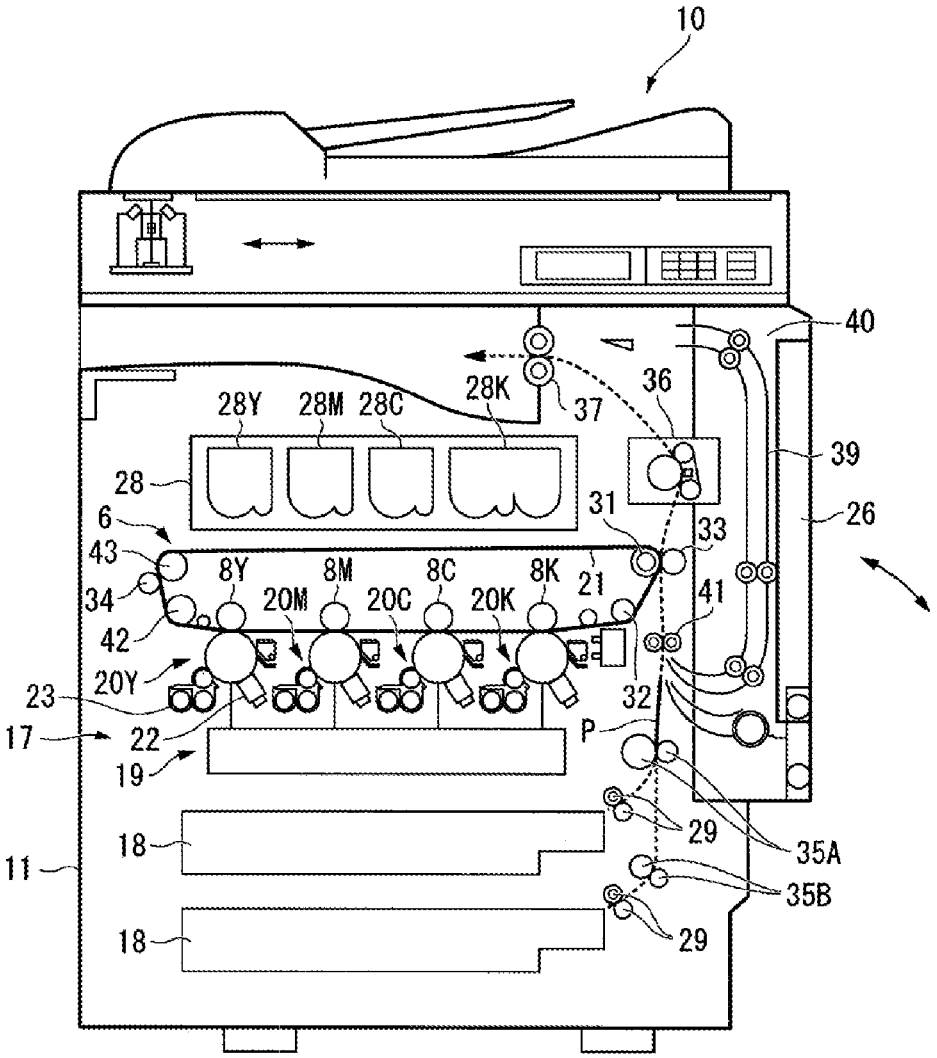
FIG. 1 is a schematic diagram of an image forming apparatus according to an embodiment.

The transfer belt unit 6 in the image forming apparatus 10 according to one embodiment will be described with reference to FIGS. 1 to 14. FIG. 1 is a schematic diagram showing an example of a schematic diagram of the image forming apparatus 10. In FIG. 1, the dimensions and shape of each member are exaggerated or simplified for ease of viewing (as in other figures). As shown in FIG. 1, the image forming apparatus 10 of the embodiment is, for example, an MFP (Multi-Function Peripheral), a printer, a copying machine, or the like.

The image forming apparatus 10 includes an apparatus main body 11 and a printer unit 17 in a central portion in the height direction. The apparatus main body 11 includes paper feed cassettes 18 at its lower portion and a manual feed tray 26. The paper feed cassettes 18 are disposed inside the apparatus main body 11. The manual feed tray 26 can be opened and closed. The manual feed tray 26 is provided on an automatic duplex device 40 which is provided on one side portion of the apparatus main body 11. The automatic duplex device 40 can also be opened and closed.

A transport mechanism 29 (transport unit) is disposed in the vicinity of each paper feed cassette 18 in the apparatus main body 11. The transport mechanism 29 feeds the sheet P fed from the paper feed cassette 18 to the main body transport path.

The printer unit 17 forms an image on the sheet P based on image data generated from an image read by the scanner unit or image data generated by a personal computer or the like. The printer unit 17 is a color printer using, for example, a tandem system. The printer unit 17 includes image process units 20Y, 20M, 20C, and 20K for yellow (Y), magenta (M), cyan (C), and black (K), respectively, which are attachable to and detachable from the apparatus main body 1. The apparatus main body 1 further includes an exposure unit 19 and a transfer belt unit 6.

The image process units 20Y, 20M, 20C, and 20K are disposed under the transfer belt 21. The image process units 20Y, 20M, 20C, and 20K are arranged from the upstream side to the downstream side in the moving direction (the direction from the left side to the right side in the figure) of the transfer belt 21 and in parallel to the moving direction.

The exposure device 19 irradiates exposure light to the image process units 20Y, 20M, 20C, and 20K, respectively. The exposure device 19 may be configured to generate a laser scanning beam as an exposure light. The exposure unit 19 may include a solid-state scanning element such as an LED that generates exposure light. The configurations of the image process units 20Y, 20M, 20C, and 20K are the same except that the color of the toner is different.

Each of the image process units 20Y, 20M, 20C, and 20K has a well-known electrophotographic system. For example, each of the image process units 20Y, 20M, 20C and 20K includes a photosensitive drum (which is more generally a photoreceptor or a photosensitive member) 2Y, 7M, 7C and 7K shown in FIG. 4 to FIG. 7. Around the photosensitive drums 7Y, 7M, 7C and 7K, the charger 22 and the developing device 23 are arranged along the rotational direction of the photosensitive drums 7Y, 7M, 7C and 7K to form an image process unit. The image process unit may further comprise a cleaning device. The primary transfer rollers 8Y, 8M, 8C, and 8K are disposed so as to face the photosensitive drums 7Y, 7M, 7C, and 7K via the transfer belt 21.

The charger 22 uniformly charges the surfaces of the photosensitive drums 7Y, 7M, 7C, and 7K. The exposure unit 19 generates exposure light modulated based on the image data of the respective colors. The exposure light exposes the surfaces of the photosensitive drums 7Y, 7M, 7C, and 7K. The exposure unit 19 forms an electrostatic latent image on the photosensitive drums 7Y, 7M, 7C, and 7K. The developing device 23 supplies toner to the photosensitive drums 7Y, 7M, 7C, and 7K by a developing roller to which a developing bias is applied. The developing device 23 develops the electrostatic latent image on the photosensitive drums 7Y, 7M, 7C, and 7K. The cleaner has blades that contact the photosensitive drums 7Y, 7M, 7C, and 7K. The blade removes residual toner on the surface of the photosensitive drum.

As shown in FIG. 1, a toner cartridge 28 is disposed above the transfer belt unit 6. The toner cartridge 28 supplies toner to each of the developing units 23 of the image process units 20Y, 20M, 20C, and 20K. The toner cartridge 28 includes toner cartridges 28Y, 28M, 28C, and 28K. The toner cartridges 28Y, 28M, 28C and 28K contain toners of yellow, magenta, cyan and black, respectively.

The transfer belt 21 is formed in an endless shape, and moves in a circular manner. The transfer belt 21 is stretched around a drive roller 31, a driven roller 32 and a tension roller 43. The transfer belt 21 is in contact with an upper side of the photosensitive drums 7Y, 7M, 7C and 7K of the image process units 20Y, 20M, 20C and 20K. At positions opposite the photosensitive drums 7Y, 7M, 7C and 7K with respect to the transfer belt 21, the primary transfer rollers 8Y, 8M, 8C and 8K of the image process units 20Y, 20M, 20C and 20K are arranged.

When the primary transfer voltage is applied to the primary transfer rollers 8Y, 8M, 8C and 8K, the toner images on the photosensitive drums 7Y, 7M, 7C and 7K are transferred to the transfer belt 21. The photosensitive drums 7Y, 7M, 7C, and 7K constitute an image carrying member which carries a toner image from a developing position to a primary transfer position.

A secondary transfer roller 33 is opposed to the driving roller 31 with the transfer belt 21 interposed therebetween. The contact portion between the transfer belt 21 and the secondary transfer roller 33 constitutes a secondary transfer position. The driving roller 31 rotates and drives the transfer belt 21. The rotationally driven transfer belt 21 forms an image carrying member which carries the toner image from the primary transfer position to the secondary transfer position.

When the sheet P passes through the secondary transfer position, a secondary transfer voltage is applied to the sheet P. When the secondary transfer voltage is applied to the secondary transfer roller 33, the secondary transfer roller 33 transfers the toner image on the transfer belt 21 to the sheet P.

As shown in FIG. 1, a belt cleaner 34 is disposed in the vicinity of a tension roller 43. The belt cleaner 34 removes the residual transfer toner on the transfer belt 21 from the transfer belt 21.

A conveying roller 35A, a conveying roller 35B, and a registration roller 41 are provided along a main conveying path from the paper cassettes 18 to the secondary transfer roller 33. The registration roller 41 adjusts the position of the leading end of the sheet P conveyed by the conveying roller 35A. The registration roller 41 conveys the sheet P and causes the leading end of the transfer region for the toner image on the sheet P to reach the secondary transfer position. The transfer region for the toner image on the sheet P is a region excluding a region where white void is formed on the end portion of the sheet P. A fixing device 36 is disposed downstream of the secondary transfer roller 33. A conveying roller 37 is disposed downstream of the fixing device 36. The conveying roller 37 discharges the sheet P.

The fixing device 36 fixes the toner image by heating and applying pressure to the toner image on the sheet P. A reverse conveyance path 39 is disposed downstream of the fixing device 36. The reverse conveyance path 39 inverts the sheet P and guides the sheet P to the upstream side of the registration roller 41. The reverse conveyance path 39 is used to perform double-sided printing. The reverse conveyance path 39 is installed in the automatic duplex device 40.

Next, the transfer belt unit 6 will be described with reference to FIG. 2 to FIG. 14.

As shown in FIG. 2 to FIG. 14, the drive roller 31 is disposed inside the transfer belt 21 on one end side of the transfer belt unit 6 and a tension roller 43 is disposed inside the transfer belt 21 on the other end side of the transfer belt unit 6. An axial end of the tension roller 43 is connected to a roller support portion 44. As shown in FIG. 5B, the roller support portion 44 is connected to a tension spring 45 that is provided on a side portion of the transfer belt unit 6 in a compressed state. The roller supporting portion 44 is pushed to the outside by the elastic force of the tension spring 45. As a result, the tension roller 43 supported by the roller support portion 44 pushes the transfer belt 21 outward. Tension is applied to the transfer belt 21 by the elastic force of the tension spring 45. The lower side of the transfer belt 21 is stretched by a first position switching roller 42 and a driven roller 32 which are provided on the left and right end portions, respectively.

The transfer belt 21 has a control mechanism 46A for the color photosensitive member and a control mechanism 46B for the monochromatic photosensitive member, for controlling the pressing and releasing of the transfer belt 21 to the photosensitive member.

The control mechanism 46A of the color photosensitive member will now be described. A slider 47 is disposed along the longitudinal direction of the transfer belt 21 on both sides (or alternatively, just one side) in the width direction of the transfer belt unit 6. Recessed portions 48 having pressing surfaces 48*a* and 48*b* on both sides thereof are provided in the middle portion of the slider 47 in the longitudinal direction. An eccentric cam 49 rotatably supported by a base portion 49*a* is provided in the concave portion 49.

For example, the cam portion 50 of the eccentric cam 49 can be rotated by 180 degrees.

Figure 2:
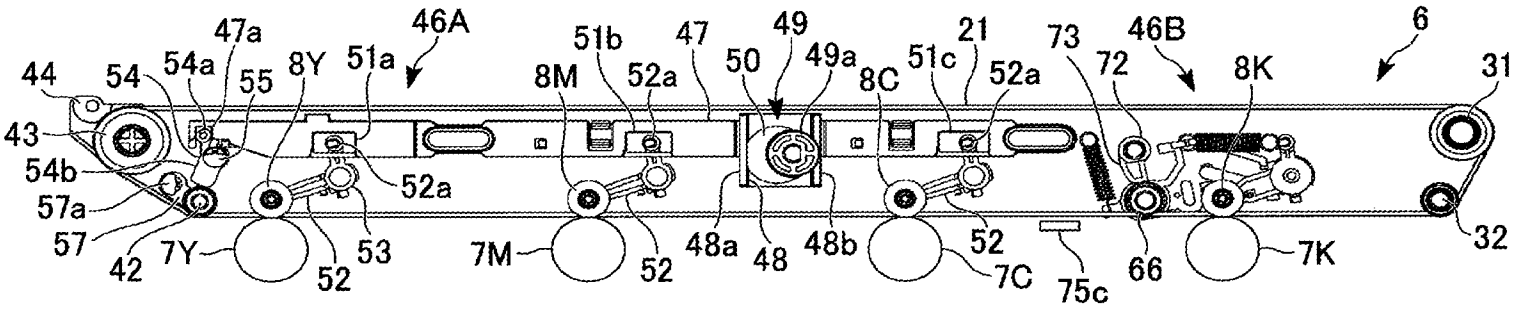
FIG. 2 is a block diagram showing a color printing position of a transfer belt unit according to an embodiment.

When the cam portion 50 is positioned on the left side in the figure, pressing surface 48*a* is pressed to move slider 47 to the left side (refer to FIG. 2). When the cam portion 50 is positioned on the right side in the figure, the pressing surface 48*b* is pressed to move the slider 47 to the right side (see FIGS. 3 and 4).

Photosensitive drums 7Y, 7M, 7C and 7K of the image process units 20Y, 20M, 20C and 20K are disposed on the lower side of the transfer belt 21 with a predetermined interval therebetween. Photosensitive drums 7Y, 7M, and 7C are color photosensitive members, and photosensitive drum 7K is a monochrome photosensitive member. On the inside of the transfer belt 21, primary transfer rollers 8Y, 8M, and 8C are disposed at predetermined intervals to press the transfer belt 21 to the photosensitive drums 7Y, 7M, and 7C, respectively. The primary transfer rollers 8Y, 8M, and 8C are respectively fixed to one end of an L-shaped arm portion 52. An interlocking part 52*a* is provided at the other end part of each arm portion 52, and a shaft part 53 is provided at the elbow portion.

Each arm portion 52 is rotatable about the shaft portion 53 by a predetermined angle.

Three notches 51*a*, 51*b*, and 51*c* are formed in the slider 47. The interlocking portion 52*a* of each arm portion 52 is inserted into the corresponding notch portion 51*a*, 51*b*, or 51*c* so as to be interlocked with each other. In FIG. 2, the slider 47 is biased to the left side in the figure by a spring member (not shown). In this state, the interlocking portion 52*a* of each arm portion 52 is held in position within the notch portions 51*a*, 51*b* and 51*c* in a non-contact manner. The arm portions 52 may be held in this state by a spring member (not shown).

When the slider 47 is moved to the left side in the figure by the eccentric cam 49, the arm portions 52 are held at positions where the interlocking portion 52*a* is not in contact with the notch portions 51*a*, 51*b* and 51*c* (see FIG. 2). When the slider 47 is moved to the right side in the figure, the arm portions 52 are pushed by the interlocking portions 52*a*, 51*b*, and 51*c* to rotate the arm portions 51. As a result, the primary transfer rollers 8Y, 8M, and 8C are separated from the photosensitive drums 7Y, 7M, and 7C with the transfer belt 21 interposed therebetween (see FIG. 3, FIG. 4).

A concave portion 47*a* is formed at an end portion of the slider 47 on the tension roller 43 side of the slider 47. One end portion 47*a* of an approximately L-shaped operating arm 54 supported rotatably by a shaft portion 55 is engaged with the slider 47 through the recess portion 54*a*. The actuating portion 54*b* of the actuating arm 54 presses against the first position switching roller 42. The first position switching roller 42 is fixed to the other end of a pivot arm 57 which is rotatable about a support shaft 57*a*. The first position switching roller 42 is pressed by the operating portion 54*b* of the operating arm 54 to press the transfer belt 21 against the photosensitive drums 7Y, 7M and 7C of the color photosensitive member. The pivot arm 57 may bias the first position switching roller 42 toward the slider 47 by a spring member (not shown).

Figure 3:
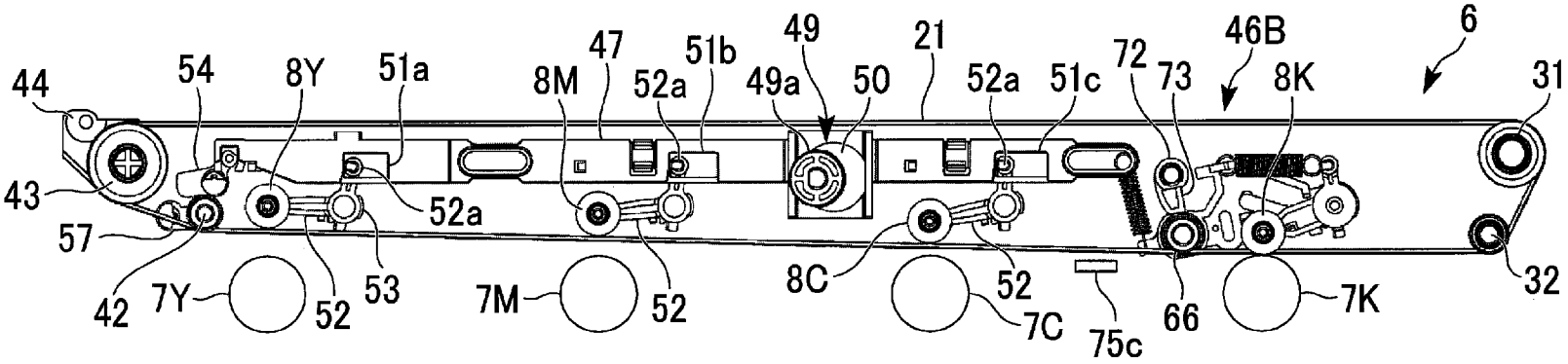
FIG. 3 is a block diagram showing a monochrome printing position of the transfer belt unit according to the embodiment.

By moving the slider 47 to the right side in the figure, as shown in FIG. 3, the actuating arm 54 is rotated in a clockwise direction about the shaft portion 55. The actuating portion 54*b* of the actuating arm 54 is disengaged from the first position switching roller 42. Thus, the first position switching roller 42 is rotated in the counterclockwise direction by the tension of the transfer belt 21 to move towards the slider 47. The primary transfer rollers BY, 8M, and 8C are also retracted at the same time as the first position switching roller 42. Therefore, the transfer belt 21 is displaced in a direction away from the photosensitive drums 7Y, 7M, and 7C. As a result of this displacement, the transfer belt 21 shifts from the color printing position shown in FIG. 2 to the monochrome printing position shown in FIG. 3.

Next, the control mechanism 46B of the monochrome photosensitive member will be described mainly with reference to FIGS. 4, 6 and 7. In the transfer belt unit 6, a control mechanism 46*b* for a monochrome photoreceptor is provided between a slider 47 and a drive roller 31.

In the control mechanism 46B of the monochrome photosensitive member, the primary transfer roller 8K is connected to a rotary shaft 61 via a connecting arm 60. An actuating arm 62 is connected to the rotary shaft 61. The connecting arm 60 and the actuating arm 62 are rotatable about the rotary shaft 61. A first coil spring 64 is disposed between a hook 61*a* provided on the rotary shaft 61 and a hook 62*a* provided on the actuating arm 62. The first coil spring 64 is held in a tensioned state. In FIG. 6, the rotary shaft 61 is biased counterclockwise by the urging force of the first coil spring 64. The primary transfer roller 8K fixed to the connecting arm 60 presses the transfer belt 21 against the monochrome photosensitive drum 7K.

Figure 6A:
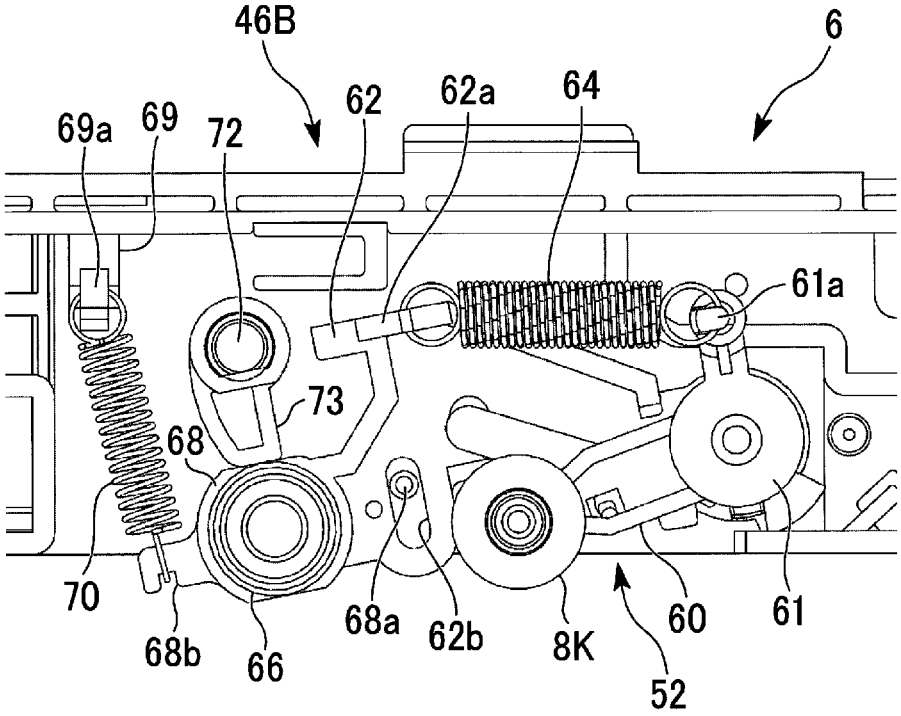
FIG. 6A is a front view of a control mechanism of the transfer belt unit in a printing position.

A second position switching roller 66 is disposed in the vicinity of the primary transfer roller 8K. In FIGS. 4 and 6A, the second position switching roller 66 presses the transfer belt 21 to the outside. The second position switching roller 66 is integrally fixed to an operating lever 68. The operating lever 68 can swing in a predetermined range around the second position switching roller 66. A pin 68*a* is provided on the operating lever 68 and is movably inserted into a long hole 62*b* formed in the actuating arm 62. The operating lever 68 is swingable in accordance with the movement range of the pin 68*a* within the long hole 62*b*.

A locking groove 68*b* is formed on the other end portion of the actuating lever 68. A locking portion 69*a* is formed on the support portion 69 fixed to the base. The second coil spring 70 in a tensioned state is engaged with the locking groove 68*b* of the actuating lever 68 and the locking portion 69*a* of the supporting portion 69. Further, a cam 73 rotatable about a support shaft 72 is provided above the second position switching roller 66. The end portion of the cam 73 abuts against the second position switching roller 66 to press it downward. The second position switching roller 66 is pressed downward by the cam 73 against the urging force of the second coil spring 70.

The second position switching roller 66 presses the transfer belt 21 to the outside at a position of the transfer belt between the photosensitive drums 7C and 7K. As a result, the transfer belt 21 is pressed against the photosensitive drums 7C and 7K. As described above, even when the transfer belt 21 is separated from the color photosensitive drums 7Y, 7M, and 7C, the transfer belt 21 is pressed against the photosensitive drum 7K by the second position switching roller 66 (see FIG. 3). At this time, the transfer belt 21 assumes a monochrome printing position.

Figure 6B:
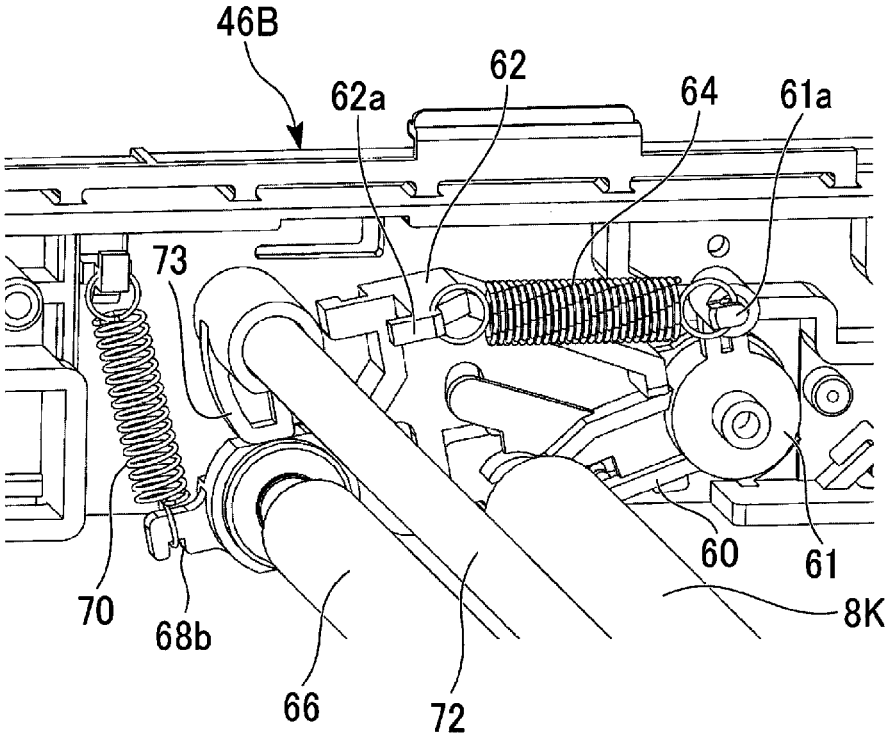
FIG. 6B is a perspective view of the control mechanism of the transfer belt unit in the printing position.
Figure 7A:
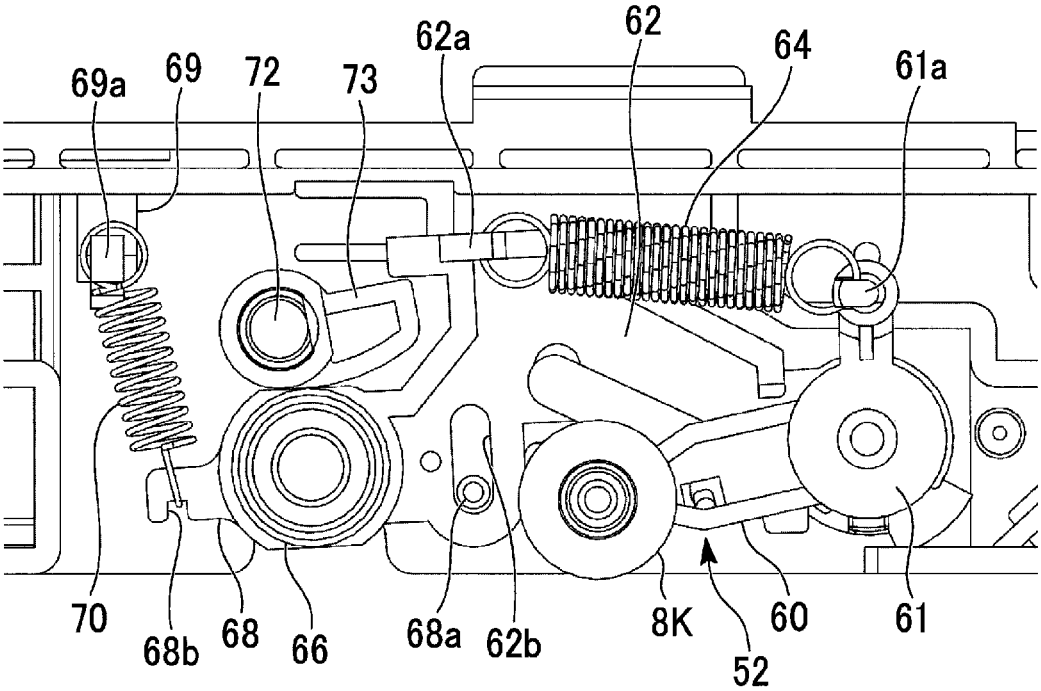
FIG. 7A is a front view of the control mechanism of the transfer belt unit in a maintenance position.
Figure 7B:
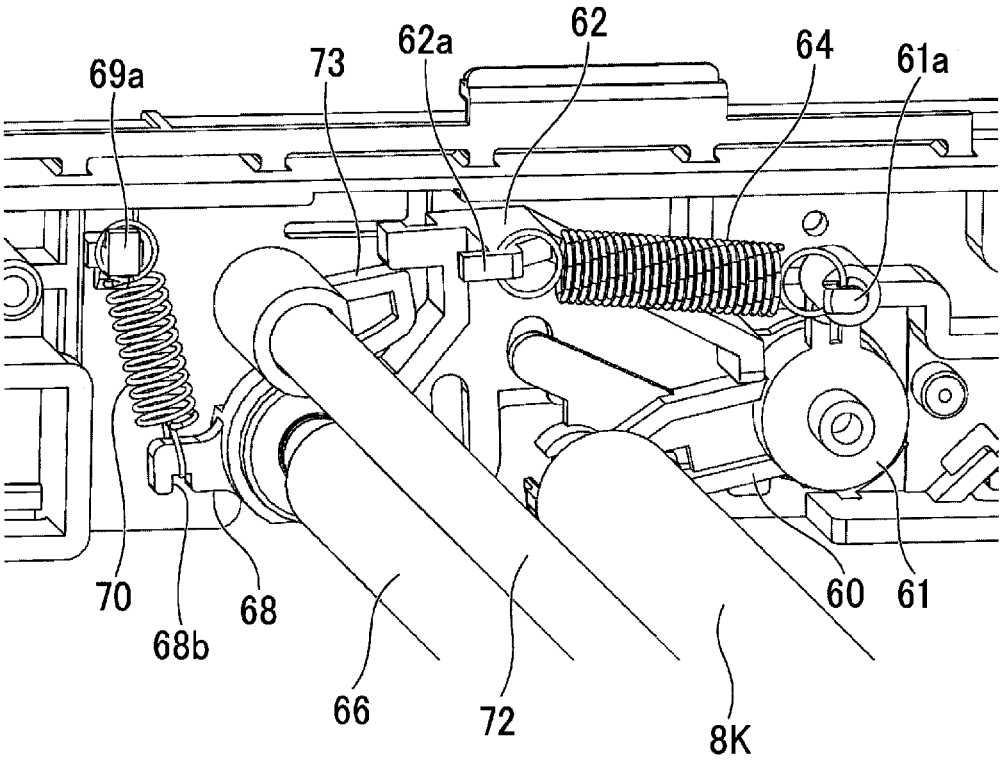
FIG. 7B is a perspective view of the control mechanism of the transfer belt unit in the maintenance position.

When the support shaft 72 shown in FIGS. 6A and 6B is rotated counterclockwise, the cam 73 is disengaged from the second position switching roller 66, as shown in FIGS. 7 and 7B. The operating lever 68 is pulled up toward the supporting shaft 72 by the urging force of the second coil spring 70.

FIGS. 7A and 7B show a lifting mechanism for the second position switching roller 66. When the cam 73 is disengaged from the second position switching roller 66, the second position switching roller 66, together with the operating lever 68, is lifted upward by the urging force of the second coil spring 70. The operating lever 68 and the second position switching roller 66 are vertically swingable in accordance with the movement range of the pin 68*a* within the long hole 62*b*.

The cam 73 also pushes the end of the actuating arm 62 when it rotates approximately 90 degrees. As a result, the actuating arm 62 rotates clockwise about the rotary shaft 61. Since the connecting arm 60 is also rotated clockwise in conjunction with the rotation of the actuating arm 62, the primary transfer roller 8K is separated from the photosensitive drum 7K. As a result, the second position switching roller 66 and the primary transfer roller 8K move together in a direction in which they are separated from the photosensitive drum 7K. Thus, the transfer belt 21 is displaced upward and separated from the photosensitive drum 7K (see FIG. 4). At this time, the transfer belt 21 assumes a maintenance position. The maintenance position is a position where the transfer belt 21 and the photosensitive drum 7K are separated from each other, and the image process units 20Y, 20M, 20C, and 20K can be exchanged.

Figure 8:
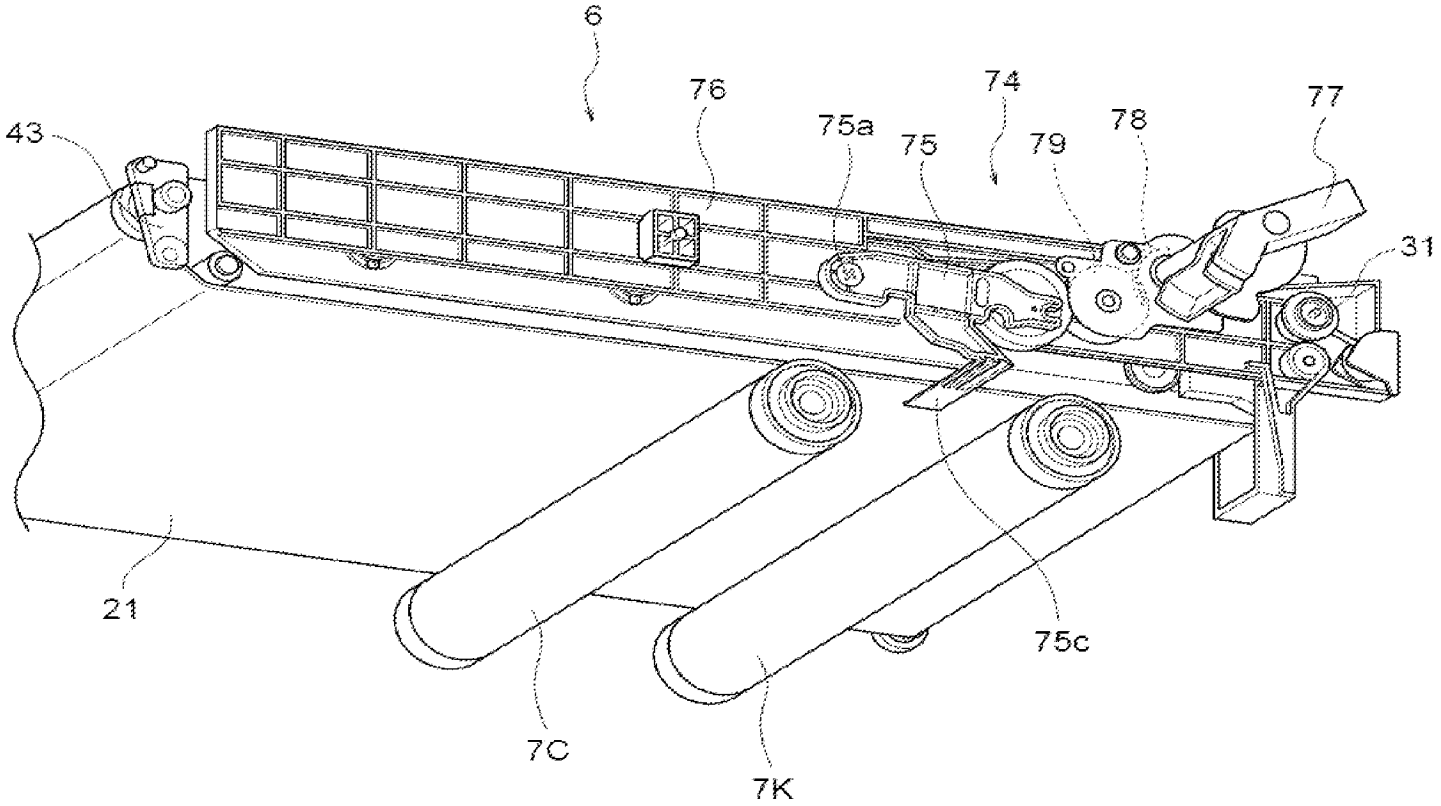
FIG. 8 is a perspective view showing a transfer belt and a holding arm of the transfer belt unit.

FIG. 8 shows a first interlocking mechanism 74 for operating a holding arm 75 serving as a supporting member for supporting the transfer belt 21 in a state in which the transfer belt 21 is separated from the monochrome photosensitive drum 7K. The first interlocking mechanism 74 is disposed on a side wall 76 of the apparatus main body 11 which faces one end portion of the transfer belt unit 6 along the longitudinal direction of the photosensitive drum. The side wall 76 is provided with an operating lever 77 which is rotatable about a shaft portion 77*a*. The operating lever 77 is formed in a substantially doglegged shape, for example, but may be formed in other shapes.

A first sector gear 78 is fixed to the shaft portion 77*a*, for example. A second sector gear 80 coaxially fixed to a disk 80*a* meshes with a disk-shaped gear 79 that is meshed with the first sector gear 78. A pin 80*b* is fixed to the second sector gear 80. The holding arm 75 is supported so as to be swingable about an axis 75*a* fixed to the side wall 76. The holding arm 75 is formed with a recess 75*b* that engages the pin 80*b* at its free end. The holding arm 75 has a support portion 75*c* which projects outward from a middle portion thereof in the longitudinal direction and is bent in a substantially doglegged shape. The support portion 75*c* extends in the width direction of the transfer belt 21 to a position below the lower surface of the transfer belt.

By rotating the operating lever 77 in a counterclockwise direction by a predetermined angle, the second sector gear 80 and the disk 80*a* are rotated counterclockwise via the first sector gear 78 and the gear 79. The pin 80*b* rotates the holding arm 75 counterclockwise about the axis 75*a* by a predetermined angle. Then, the transfer belt 21 can be lifted upward by the support portion 75*c* of the holding arm 75. The holding arm 75 holds and lifts the one end portion of the transfer belt 21 in the width direction by the support portion 75*c*.

Figure 10:
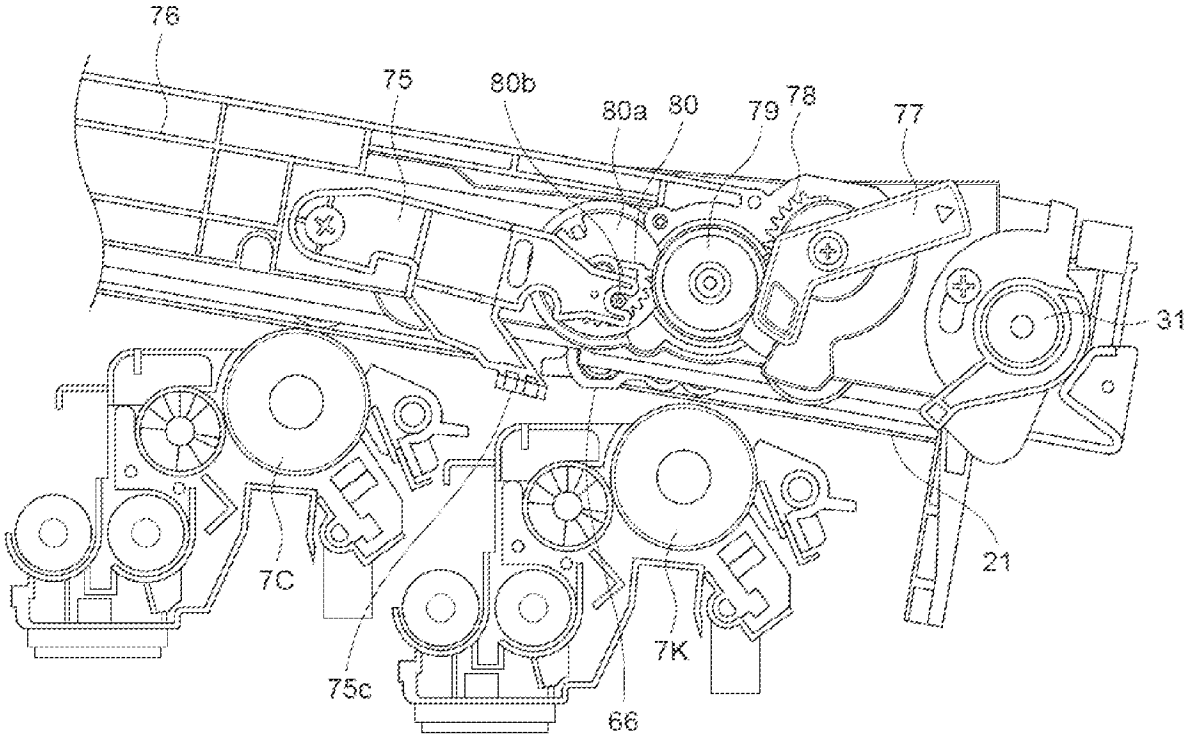
FIG. 10 an enlarged view that shows the position of the transfer belt and the support portion during the color printing process.

In the color printing position (see FIG. 10) and the monochrome printing position (see FIG. 11), the operating lever 77 is in a position to separate the transfer belt 21 from the support portion 75*c* of the holding arm 75. The position of the transfer belt 21 shown in FIG. 10 is assumed to be an initial position (see FIG. 10). The operating lever 77 rotates by a predetermined angle, and the operating position in which the transfer belt 21 is held by the support portion 75*c* becomes the maintenance position (see FIG. 12).

In the maintenance position, when the image process unit 20K is replaced, the transfer belt 21 can be separated from the photosensitive drum 7K to prevent damage. When viewed in the moving direction of the transfer belt 21, the holding arm 75 is provided on the upstream side of the photosensitive drum 7K. In this embodiment, the first interlocking mechanism 74 is provided only at one end portion in the width direction of the transfer belt 21, but may be provided at both end portions in other embodiments.

Although the operating lever 77, the first interlocking mechanism 74, and the holding arm 75 are preferably disposed on the front side of the image forming apparatus 10, i.e., on the front side of the electrophotographic process unit (EPU) (not shown), the position of the operating lever 77, the first interlocking mechanism 74, and the holding arm 75 can be appropriately selected.

Figure 5B:
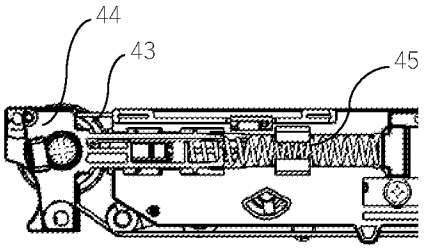
FIG. 5B is a cross sectional view of one side of the transfer belt unit.
Figure 5A:
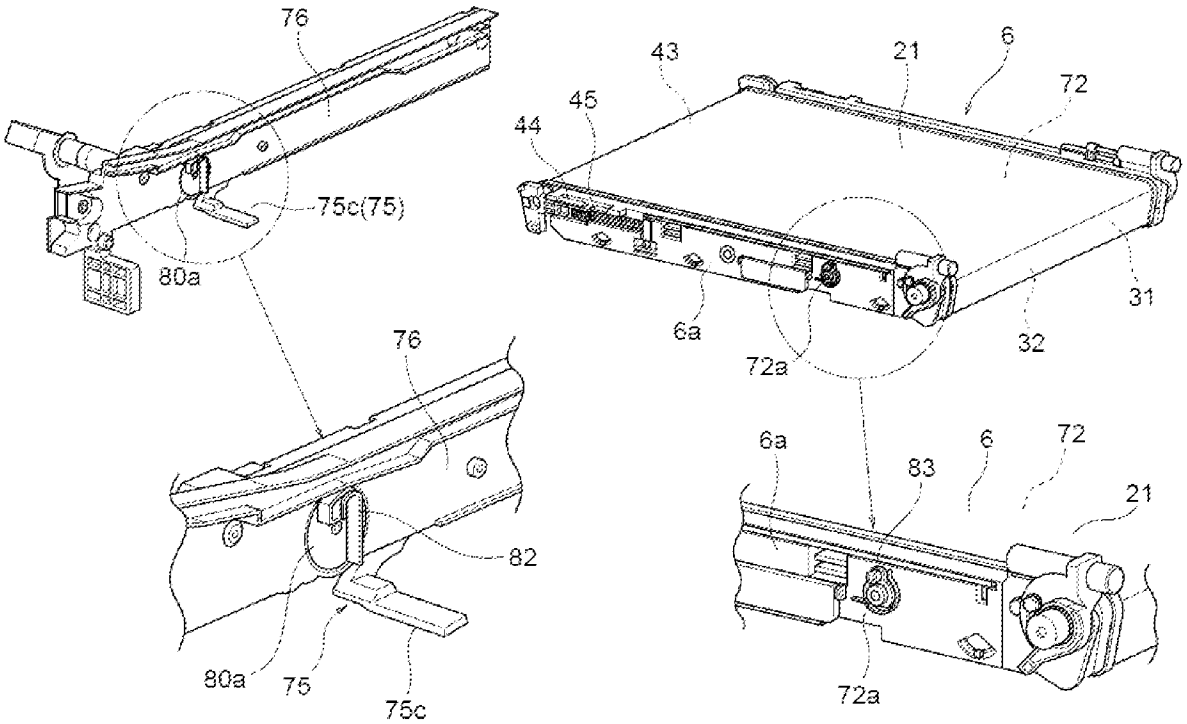
FIG. 5A illustrate perspective views of the transfer belt unit according to the embodiment.
Figure 13:
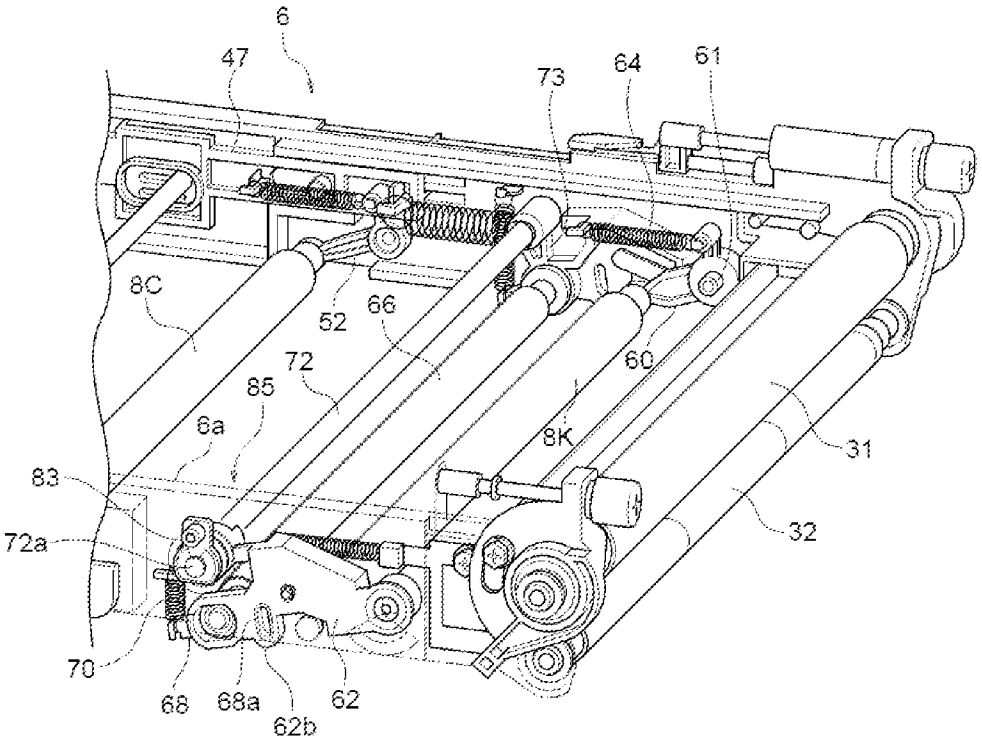
FIG. 13 is a perspective view of a supporting shaft and a second tension switching roller of the transfer belt unit.

FIG. 5A is a view showing the side wall 76 having the operating lever 77, the first interlocking mechanism 74, and the holding arm 75 separated from the side surface 6*a* of the transfer belt unit 6. The disk 80*a* in the first interlocking mechanism 74 is rotatably supported by the side wall 76. On the back surface of the disc 80*a*, there is formed a fitting receiving portion 82 which protrudes substantially in the shape of a substantially inverted letter J or a substantially U-shaped letter. As shown in FIG. 5A and FIG. 13, the side surface 6*a* of the transfer belt unit 6 opposed thereto is formed in such a manner that one end portion 72*a* of the support shaft 72 protrudes, for example. The end portion 72*a* is disposed such that a circular portion of the support shaft 72 is coaxial with the disk 80*a*. Further, for example, a fitting projection 83 protrudes from the head portion of the head portion 72*a*, which has a small diameter. The fitting projection 83 is fitted to the fitting receiving portion 82 of the disc 80*a*. The fitting projection 83, the fitting receiving portion 82 of the disc 80*a* and the end portion 72*a* of the supporting shaft 72 constitutes a link fitting portion.

Therefore, when the operating lever 77 is rotated, the supporting shaft 72 rotates by a predetermined angle in conjunction with the rotation of the disk 80*a* of the first interlocking mechanism 74, so that the cam 73 of the supporting shaft 72 is disengaged from the second position switching roller 66. Then, the second position switching roller 66 and the primary transfer roller 8K are separated from the photosensitive drum 7K by the urging force of the second coil spring 70. When the operating lever 77 is returned to the original initial position, the first interlocking mechanism 74 and the second interlocking mechanism 85 are rotated in reverse, so that the holding arm 75 and the second position switching roller 66 are returned to their initial positions.

The first sector gear 78, the gear 79, the disk 80*a*, and the support shaft 72 are interlocked with the first interlocking mechanism 74 to separate the second position switching roller 66 from the photosensitive drum 7K in the second interlocking mechanism 85.

Figure 14A:
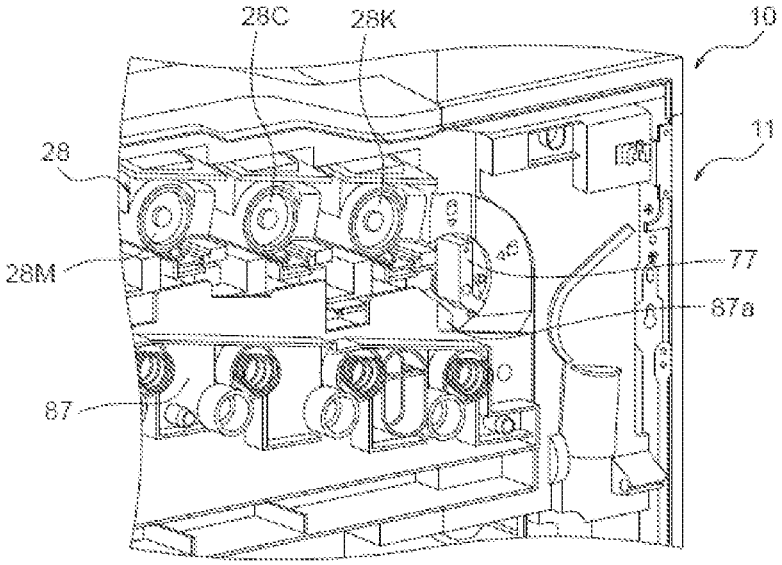
FIG. 14A is a perspective view showing a state in which a waste toner box is locked.
Figure 14B:
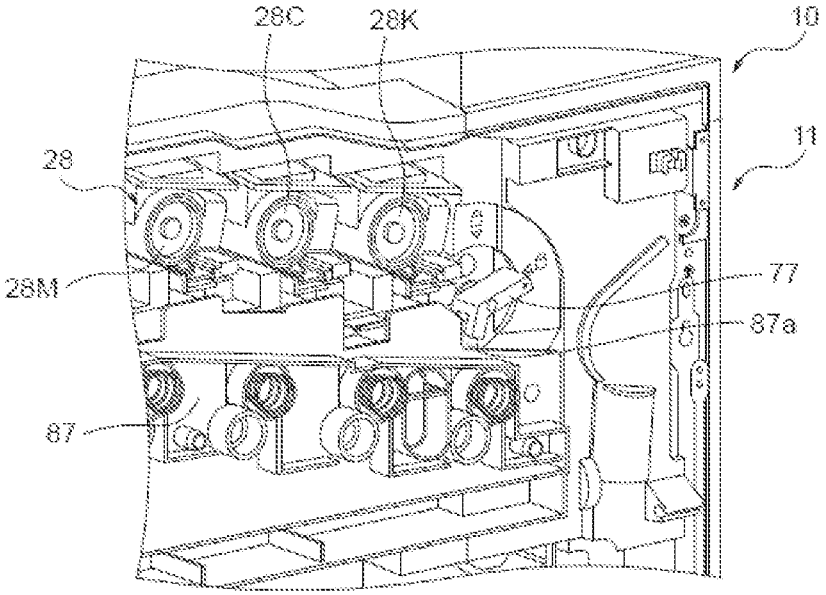
FIG. 14B is a diagram showing a state in which the waste toner box is unlocked.

As shown in FIGS. 14A and 14B, a waste toner box 87 is disposed on the lower side of the toner cartridge 28, for example, on the front side of the apparatus main body 11 of the image forming apparatus 10. The waste toner box 87 is removably mounted. The operating lever 77 of the first interlocking mechanism 74 is detachably attached to the engaging end portion 87*a* of one end of the waste toner box 87 when the waste toner box 87 is attached to the apparatus main body 11. The operating lever 77 is supported so as to be rotatable at a position that is projecting forward by the shaft portion 77*a* from the side wall 76 on which the first interlocking mechanism 74 is installed.

As shown in FIG. 14A, a part of the operating lever 77 is engaged with the engaging end portion 87*a* of the waste toner box 87 at an initial position. In this state, the waste toner box 87 is locked so as not to be pulled out, so that it is prevented from being detached. As shown in FIG. 14B, the operating lever 77 is disengaged from the engaging end portion 87*a* of the waste toner box 87 at an operating position which is rotated from the initial position. In this state, the waste toner box 87 can be pulled out from the apparatus main body 11. Therefore, the operating lever 77 also serves to prevent the waste toner box 87 from being detached.

That is, the waste toner box 87 is disposed so as to face the end portion of the image process unit 20 in the longitudinal direction of the photosensitive drum 6. Therefore, at the time of exchanging the image process unit 20, it may be necessary to remove the waste toner box 87. Therefore, when the image process unit 20 is exchanged, the transfer belt 21 is always lifted by the holding arm 75, and then the lock of the waste toner box 87 is released. As a result, the transfer belt 21 is separated from the photosensitive drum 7K. Therefore, the image process unit can be replaced without damaging the transfer belt 21.

Although the second interlocking mechanism 85 is operated in conjunction with the operation of the first interlocking mechanism 74 by the operating lever 77 in the above description, both of them are operated substantially simultaneously. The first interlocking mechanism 74 may be operated in conjunction with the operation of the second interlocking mechanism 85 by the operating lever 77.

The image forming apparatus 10 and the transfer belt unit 6 according to the present embodiment have the structure described above. Next, an operation method of the transfer belt unit 6 will be described with reference to FIG. 2 to FIG. 4 and FIG. 10 to FIG. 12. In the color printing position shown in FIG. 2 and FIG. 10, the slider 47 is positioned on the left side. The first position switching roller 42 presses the lower transfer belt 21 by being pressed by the operating portion 54*b* of the operating arm 54. The second position switching roller 66 also presses the lower transfer belt 21 by the cam 73 of the support shaft 72. The transfer belt 21 is pressed to the photosensitive drums 7Y, 7M, 7C and 7K by the primary transfer rollers BY, 8M, 8C and 8K. The support portion 75*c* of the holding arm 75 is held in a non-contact state with the transfer belt 21.

In this state, when the primary transfer voltage is applied to the primary transfer rollers BY, 8M, 8C and 8K, the toner images on the photosensitive drums 7Y, 7M, 7C and 7K are transferred to the transfer belt 21. When the sheet P passes through the second transfer position between the drive roller 31 and the secondary transfer roller 33, a secondary transfer voltage is applied to the secondary transfer roller 33. When the secondary transfer voltage is applied to the secondary transfer roller 33, the secondary transfer roller 33 transfers the toner image on the transfer belt 21 to the sheet P. Then, the toner image on the sheet P is fixed by the fixing device 36. By the image forming apparatus 10 of the embodiment, full-color printing is possible.

Figure 11:
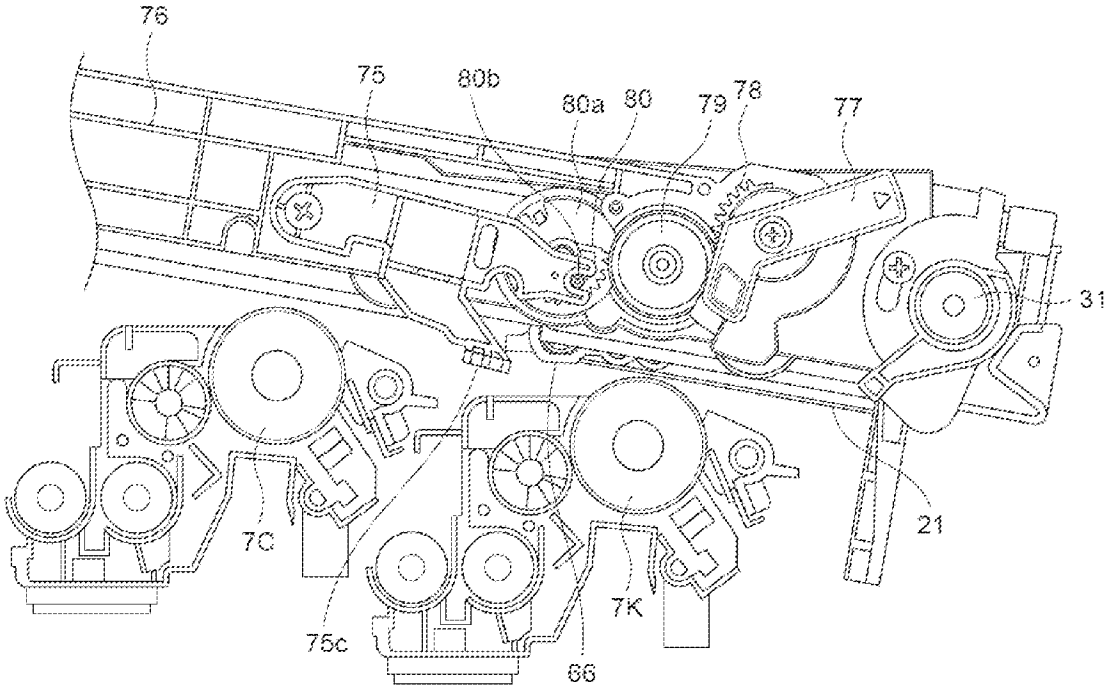
FIG. 11 is an enlarged view showing the position of the transfer belt and the support member during the monochrome printing process.

Next, when shifting to the monochrome printing position shown in FIGS. 3 and 11 from the color printing position, the eccentric cam 49 is rotated by 180 degrees by the control mechanism 46A of the color photosensitive member. Then, the slider 47 is moved to the right side. The operating arm 54 is rotated clockwise in conjunction with the movement of the slider 47, and is disengaged from the first position switching roller 42. The first position switching roller 42 is rotated counterclockwise by the tension of the transfer belt 21. In conjunction with the movement of the slider 47, the three arm portions 52 are also each rotated about its respective shaft portion 53. Thus, the primary transfer rollers 8Y, 8M, and 8C are rotated in a direction away from the photosensitive drums 7Y, 7M, and 7C. The transfer belt 21 is thus separated from the color photosensitive drums 7Y, 7M, and 7C for color.

The primary transfer roller 8K remains on the side of the transfer belt 21. The transfer belt 21 is set in a monochrome mode in which it is brought into contact only with the photosensitive drum 7K for monochrome. The second position switching roller 66 presses the transfer belt 21 against the photosensitive drum 7K (see FIG. 6).

The holding arm 75 is kept in a state in which the support portion 75*c* is separated from the transfer belt 21.

Therefore, monochrome printing using only the photosensitive drum 7K is possible.

Figure 4:
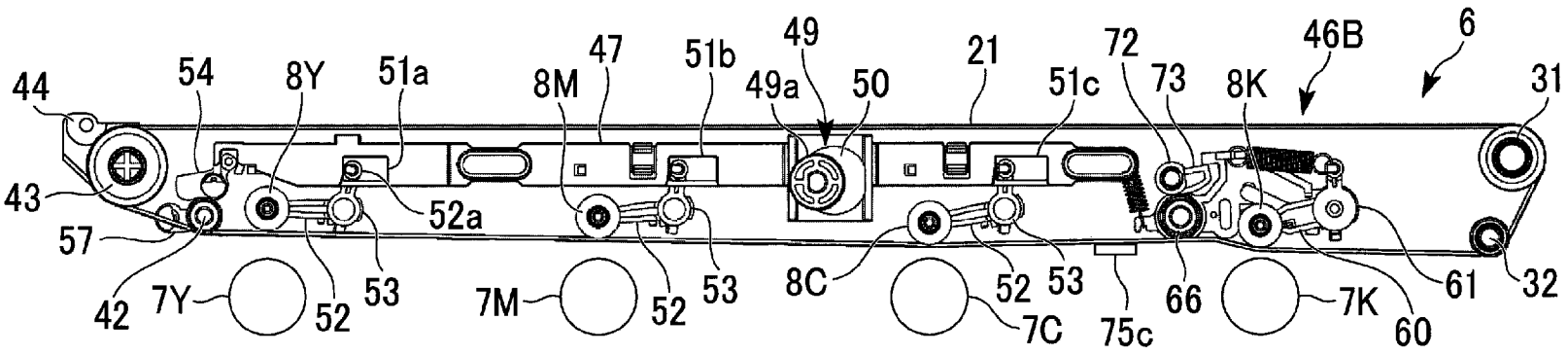
FIG. 4 is a block diagram showing a maintenance position of the transfer belt unit according to the embodiment.
Figure 9:
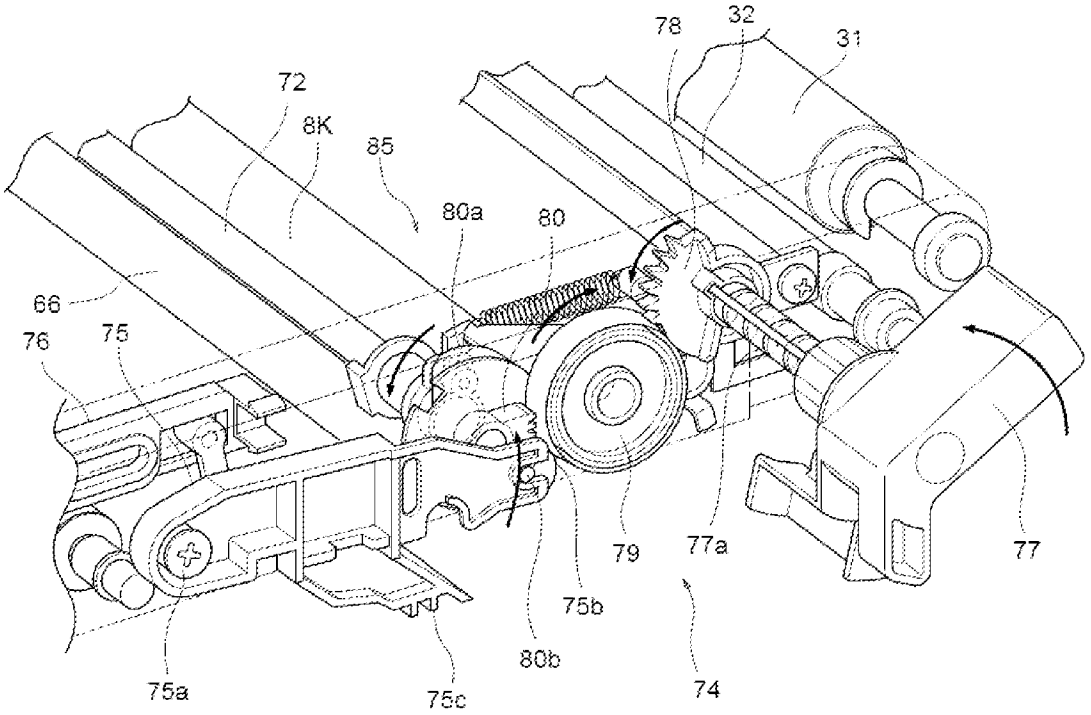
FIG. 9 is an enlarged view of a support portion and a first interlocking mechanism of FIG. 8.
Figure 12:
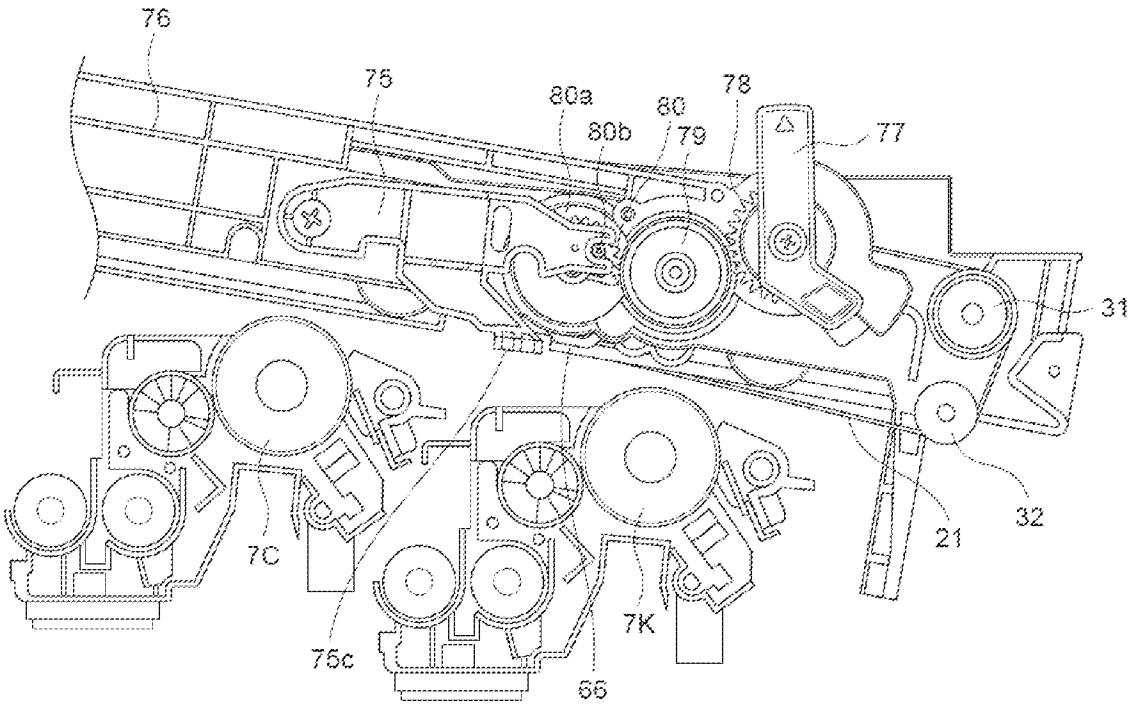
FIG. 12 an enlarged view showing the maintenance position of the transfer belt and the support portion.

Next, when shifting to the maintenance position shown in FIGS. 4 and 12 from the monochrome printing position, the operating lever 77 is rotated counterclockwise by a predetermined angle from the initial position to the operating position in the counterclockwise direction (see FIG. 9). Then, in the second interlocking mechanism 85, the first sector gear 78 is rotated by the same angle via the shaft portion 77*a*, and the second sector gear 80 and the disk 80*a* are rotated by a predetermined angle via the gear 79. The support shaft 72 is rotated by a predetermined angle from the fitting receiving portion 82 through the fitting projection 83 of the supporting shaft 72 in conjunction with the rotation of the disk 80*a*. Then, as shown in FIG. 7, the cam 73 of the support shaft 72 is disengaged from the second position switching roller 66. The second position switching roller 66 is separated from the photosensitive drum 7K by the urging force of the second coil spring 70.

At the same time, in the first interlocking mechanism 74, the holding arm 75 is rotated counterclockwise around the axis 75*a* by the rotation of the second sector gear 80 via the pin 80*b*.

Further, in FIGS. 4 and 7, the actuating arm 62 is rotated clockwise about the rotary shaft 61 by being pressed by the cam 73 of the rotating support shaft 72. Then, since the connecting arm 60 also rotates around the rotary shaft 61, the primary transfer roller 8K is separated from the photosensitive drum 7K. When the second position switching roller 66 and the primary transfer roller 8K are moved, the transfer belt 21 is separated from the photosensitive drum 7K by the tension thereof. Since the holding arm 75 is rotated by a predetermined angle, the support portion 75*c* lifts the one end portion of the transfer belt 21 so as to be held in a position separated from the photosensitive drum 7K.

In this manner, by operating the operating lever 77, the backward movement of the second position switching roller 66 from the photosensitive drum 7K and the lifting of the transfer belt 21 by the support portion 75*c* of the holding arm 75 are performed in conjunction with each other.

In this way, the transfer belt 21 is moved to a position away from the 4 photosensitive drums 7Y, 7M, 7C and 7K. Sufficient space can be secured between the transfer belt 21 and the photosensitive drums 7Y, 7M, 7C, and 7K. Even when both ends in the width direction of the transfer belt 21 elongate due to aging, they can be held in a position separated from the photosensitive drums 7Y, 7M, 7C and 7K by the support portion 75*c*. Thus, the transfer belt 21 does not sag toward the photosensitive drums 7Y, 7M, 7C, and 7K due to its own weight. Therefore, the photosensitive drums 7Y, 7M, 7C and 7K and the components thereof can be removed without being brought into contact with the transfer belt 21, and can be replaced.

In FIG. 14, in the initial position of the operating lever 77, where copying is possible, the waste toner box 87 is locked to the engagement end portion 87*a*. By turning the operating lever 77 to the operating position, the operating lever 77 is disengaged from the engaging end portion 87*a*. In this state, the waste toner box 87 can be pulled out from the apparatus main body 11, so that the waste toner can be discarded.

As described above, the image forming apparatus 10 according to the present embodiment and the transfer belt unit 6 thereof are provided.

By operating the operating lever 77, the separation of the second position switching roller 66 from the photosensitive drum 7K and the lifting of the transfer belt 21 by the support portion 75*c* of the holding arm 75 can be carried out in conjunction with each other. Even if both end portions of the transfer belt 21 elongate due to aging, a sufficient space can be secured at a position where the transfer belt 21 is separated from the photosensitive drums 7Y, 7M, 7C and 7K. Therefore, the transfer belt 21 can be prevented from being damaged when the photosensitive drums 7Y, 7M, 7C, and 7K are replaced.

Moreover, since the tension of the transfer belt 21 is not increased, the elongation of the transfer belt 21 is not increased. In particular, since both end portions in the width direction of the transfer belt 21 are easily elongated with time, the one end portion of the transfer belt 21 is held by the support portion 75*c*. As a result, it is possible to prevent the transfer belt 21 from drooping due to the elongation of the transfer belt 21.

Further, the waste toner box 87 can be pulled out only in the operating position where the transfer belt 21 is held by the support portion 75*c* of the holding arm 75 by the operation of the operating lever 77. Therefore, it is possible to prevent the transfer belt 21 from being damaged at this point.

In the following description of the modification of the present embodiment, the same reference numerals are used for the same or similar parts and elements as those of the embodiment described above.

In the embodiment described above, the holding arm 75 is provided at one end portion in the width direction of the transfer belt 21, and only the end portion of the transfer belt 21 is supported. Alternatively, the holding arms 75 may be provided at both ends in the width direction of the transfer belt 21. Further, the holding arm 75 may be provided at one end portion or both end portions in the width direction of the transfer belt 21, and the support portion 75*c* may be extended to the entire length in the width direction.

Figure 15:
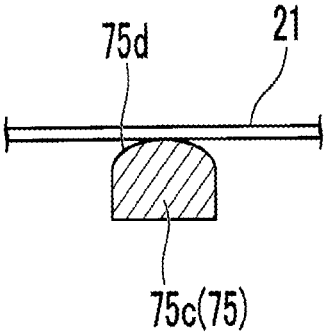
FIG. 15 is a diagram showing a modification example of the support member.

Further, as shown in FIG. 15, the support portion 75*c* of the holding arm 75 may be formed to have a convex surface on a surface 75*d* which abuts against the transfer belt 21. As a result, it is possible to decrease the possibility that the holding arm 75 will damage the transfer belt 21. As another example, the support portion 75*c* of the holding arm 75 may be formed in a round bar shape.

In the embodiment described above, the holding arm 75 is provided on the upstream side of the photosensitive drum 7K in the moving direction of the transfer belt 21. Alternatively, the holding arm 75 may be provided on the downstream side of the photosensitive drum 7K.

In addition, the holding arm 75 may be attached to the second position switching roller 66 instead of the structure in which the holding arm 75 is attached to the side wall 76 and the pin 75*b* of the second sector gear 80 is attached to the side wall 76. In this case, the position of the support portion 75*c* of the holding arm 75 can be switched in conjunction with the switching of the position of the second position switching roller 66. In addition, the first interlocking mechanism 74 and the second interlocking mechanism 85 may each have a substantially identical configuration. Therefore, the holding arm 75 can hold the transfer belt 21 by the support portion 75*c* in conjunction with the second position switching roller 66, and can be separated from the photosensitive drum 7K.

In the embodiment described above, the transfer belt unit 6 provided in the image forming apparatus 10 has been described. The transfer belt unit 6 according to the embodiment has been described with reference to a unit including the transfer belt 21. However, the transfer belt unit 6 of the present embodiment is not limited to the image forming apparatus 10. The present invention is applicable to various types of transfer belt units 6 having an endless transfer belt 21.

In the embodiment, the second position switching roller 66 is not limited to a roller. It may also be a bar, a plate or the like. These members are included in the switching member. The operating lever 77 may have a disc shape, a handle shape, or the like instead of the lever shape. These are included in the operating member. The second position switching roller 66 is included in the position switching member. The first interlocking mechanism 74 and the first interlocking mechanism 85 are included in the control unit.

According to at least one embodiment described above, the first interlocking mechanism 74 and the second interlocking mechanism 85 are interlocked with each other by the operating lever 77, and the holding arm 75 for holding the end portion of the transfer belt 21 and the second position switching roller 66 for separating the transfer belt 21 from the photosensitive drum 7K are provided. Therefore, even if both end portions of the transfer belt 21 are elongated due to aging, a sufficient space can be secured at a position where the transfer belt 21 is separated from the photosensitive drums 7Y, 7M, 7C, and 7K. The transfer belt 21 can be prevented from being damaged when the photosensitive drums 7Y, 7M, 7C and 7K are replaced. Moreover, there is no need to increase the tension of the transfer belt 21.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a plurality of photosensitive drums;

a transfer belt above the photosensitive drums and having an outer surface that faces the photosensitive drums;

a tension roller in contact with an inner surface of the transfer belt;

a cam that is in contact with the tension roller and is movable to a first position at which the cam applies a first tension to the transfer belt through the tension roller and a second position at which the cam applies a second tension less than the first tension to the transfer belt through the tension roller;

a support below the transfer belt and having a supporting surface that faces the outer surface of the transfer belt; and a lever that is mechanically linked to the cam and the support and is rotatable from a third position at which the cam is in the first position to a fourth position at which the cam is in the second position, wherein, as the lever is moved from the third position to the fourth position, the supporting surface is raised against the outer surface of the transfer belt.

2. The image forming apparatus according to claim 1, wherein the transfer belt has first and second opposite ends in a width direction thereof, and the supporting surface is raised against the outer surface of the transfer belt at the first end when the lever is moved from the third position to the fourth position.

3. The image forming apparatus according to claim 2, wherein the supporting surface that faces the outer surface of the transfer belt has a convex shape.

4. The image forming apparatus according to claim 1, wherein the photosensitive drums include a first photosensitive drum that is used in forming color images and a second photosensitive drum that is used in forming monochrome images, and the support is between the first and second photosensitive drums.

5. The image forming apparatus according to claim 4, wherein none of the photosensitive drums is between the first and second photosensitive drums, and the second photosensitive drum is downstream of the first photosensitive drum with respect to a moving direction of the transfer belt.

6. The image forming apparatus according to claim 1, further comprising:

a plurality of transfer rollers, each of which contacts an inner surface of the transfer belt at a position that is opposite to one of the photosensitive drums, wherein during color printing, each of the transfer rollers presses the transfer belt against the corresponding photosensitive drum on an opposite side of the transfer belt therefrom, and during monochrome printing, only one of the transfer rollers presses the transfer belt against the corresponding photosensitive drum on an opposite side of the transfer belt therefrom.

7. The image forming apparatus according to claim 6, wherein during maintenance, the lever is moved to the fourth position, and none of the transfer rollers presses the transfer belt against the corresponding photosensitive drum on an opposite side of the transfer belt therefrom.

8. The image forming apparatus according to claim 1, further comprising:

a waste toner box having a tab which is pulled on to remove the waste toner box from the image forming apparatus, wherein the tab is covered by the lever when the lever is at the third position and is exposed when the lever is at the fourth position to allow the tab to be pulled on to remove the waste toner box from the image forming apparatus.

9. An image forming apparatus comprising:

a first photosensitive drum used for color printing;

a second photosensitive drum used for monochrome printing;

a transfer belt above the photosensitive drums and having an outer surface that faces the photosensitive drums;

first and second tension rollers that are each in contact with an inner surface of the transfer belt and are each movable in a first direction to increase tension in the transfer belt and in a second direction opposite to the first direction to decrease tension in the transfer belt;

a support below the transfer belt and having a supporting surface that faces the outer surface of the transfer belt; and a lever that is mechanically linked to a cam, which is in contact with the first tension roller, and the support, and is rotatable from a first position to a second position, wherein, as the lever is moved from the first position to the second position, the first tension roller is moved in the second direction and the supporting surface is raised against the outer surface of the transfer belt.

10. The image forming apparatus according to claim 9, further comprising:

a slider that is mounted to be movable linearly inside the transfer belt and mechanically linked to a movable arm that is rotated as the slider moves linearly to vary the tension in the transfer belt.

11. The image forming apparatus according to claim 10, wherein the slider is moved to a third position at which the transfer belt is in contact with the first photosensitive drum and to a fourth position at which the transfer belt is not in contact with the first photosensitive drum.

12. The image forming apparatus according to claim 11, further comprising:

an eccentric cam configured to move the slider linearly between the third and fourth positions.

13. The image forming apparatus according to claim 12, further comprising:

a plurality of transfer rollers, each of which contacts an inner surface of the transfer belt at a position that is opposite to one of the photosensitive drums, wherein during color printing, each of the transfer rollers presses the transfer belt against the corresponding photosensitive drum on an opposite side of the transfer belt therefrom, and during monochrome printing, only one of the transfer rollers presses the transfer belt against the corresponding photosensitive drum on an opposite side of the transfer belt therefrom.

14. The image forming apparatus according to claim 13, wherein during maintenance, the lever is moved to the second position, and none of the transfer rollers presses the transfer belt against the corresponding photosensitive drum on an opposite side of the transfer belt therefrom.

15. The image forming apparatus according to claim 9, wherein the transfer belt has first and second opposite ends in a width direction thereof, and the supporting surface is raised against the outer surface of the transfer belt at the first end when the lever is moved from the third position to the fourth position.

16. The image forming apparatus according to claim 15, wherein the supporting surface that faces the outer surface of the transfer belt has a convex shape.

17. The image forming apparatus according to claim 9, wherein the support is between the first and second photosensitive drums.

18. The image forming apparatus according to claim 17, further comprising:

third and fourth photosensitive drums that are used for color printing, wherein the third and fourth photosensitive drums are both upstream of the first and second photosensitive drums with respect to a moving direction of the transfer belt.

19. The image forming apparatus according to claim 9, further comprising:

a waste toner box having a tab which is pulled on to remove the waste toner box from the image forming apparatus, wherein the tab is covered by the lever when the lever is at the third position and is exposed when the lever is at the fourth position to allow the tab to be pulled on to remove the waste toner box from the image forming apparatus.

20. A method of switching an image forming apparatus from a printing mode to a maintenance mode, wherein the image forming apparatus includes a plurality of photosensitive drums, a transfer belt above the photosensitive drums and having an outer surface that faces the photosensitive drums, a tension roller in contact with an inner surface of the transfer belt, a cam that is in contact with the tension roller and is movable to a first position at which the cam applies a first tension to the transfer belt through the tension roller and a second position at which the cam applies a second tension less than the first tension to the transfer belt through the tension roller, and a support below the transfer belt and having a supporting surface that faces the outer surface of the transfer belt, said method comprising:

rotating a lever that is mechanically linked to the cam from a third position at which the cam is in the first position to a fourth position at which the cam is in the second position; and as the lever is moved from the third position to the fourth position, raising the supporting surface against the outer surface of the transfer belt through mechanical links that are between the lever and the support.

* * * * *